US005466526A

United States Patent [19]

Magata

[11] Patent Number: 5,466,526

[45] Date of Patent: Nov. 14, 1995

[54] FAR INFRARED RADIANT COMPOSITE FIBER CONTAINING METAL

[76] Inventor: Katsumi Magata, 16-18, Shinashiyakami, Suita City, Osaka, Japan

[21] Appl. No.: 304,307

[22] Filed: Sep. 12, 1994

Related U.S. Application Data

[63] Continuation-in-part of Ser. No. 930,132, Oct. 8, 1992, abandoned, and a continuation-in-part of Ser. No. 930,131, Oct. 8, 1992, abandoned.

[30] Foreign Application Priority Data

Jul. 16, 1992 [JP] Japan ..... 4-213557
Jul. 16, 1992 [JP] Japan ..... 4-213558

[51] Int. Cl.[6] ..... D02G 3/00

[52] U.S. Cl. ..... 428/372

[58] Field of Search ..... 428/229, 230, 428/242, 253, 323, 329, 364, 372, 398

[56] References Cited

U.S. PATENT DOCUMENTS 3,644,251 2/1972 Wilhelmi ..... 260/26
4,999,243 3/1991 Malda ..... 428/372

*Primary Examiner*—James J. Bell
*Attorney, Agent, or Firm*—Joseph C. Mason, Jr.; Ronald E. Smith

[57] ABSTRACT

This invention relates to knitting and textile for underwear, socks and stockings comprising fiber containing metal, which includes fiber materials mixed-spun with 2–50% polyurethane elastic fiber to which platinum and at least one metal oxide selected from the group consisting of alumina, silica, and titania are mixed as essential components. The metal oxides or platinum are mixed in the polyurethane elastic fiber to provide expandability. Electromagnetic radiation (far infrared radiation) liberated from the metal oxides is emitted in close contact with the human body, permitting infrared radiation to warm the body.

1 Claim, 5 Drawing Sheets

FAR INFRARED RADIANT COMPOSITE FIBER CONTAINING METAL

This is a continuation-in-part of application(s) Ser. No. 07/930,132 filed on Oct. 8, 1992, now abandoned, and U.S. Pat. No. 07/930,131, filed on Oct. 8, 1992, now abandoned.

FIELD OF THE INVENTION

This invention relates to knitting and textile for underwear, socks and stockings comprising fiber containing metal and the object of the present invention is to provide knitting and textile for underwear, socks and stockings comprising fiber containing metal which not only provides flexibility, excellent smooth touch when they are put on, and agreeable wear comfort while they are worn but which also emits electromagnetic radiation liberated from metal oxides positioned near body of the wearer to work effectively on contact as soon as they are put on, and to provide small thermal conductivity while they are worn, so that an extremely good heat-retaining effect is manifested and the blood flow rate tends to rise where they contact the body.

1.Description of Prior Art

In general, cotton, nylon, polyester, acrylic, and urethane fiber are popularly used as fiber materials forming men's underwear such as long-sleeved shirts, shirts with half-length sleeves, and drawers; ladies' underwear such as tee shirts, semi-long-sleeved shirts and panties; and socks, and stockings, and these fiber materials are properly selected according to wearing seasons and mixed-spun at an optional ratio to form underwear, socks and stockings.

For example, underwear, socks and stockings for summer is formed with fiber materials primarily comprising cotton in view of its permeability and absorbency, while underwear, socks and stockings for winter, in addition to said fiber materials, usually includes wool which is frequently mixed-spun to improve the heat-retaining property of underwear, socks and stockings.

Recently, in view of the heat-retaining property of far infrared radiation, underwear, socks and stockings using fiber mixed with far infrared irradiating ceramics as a component material have been provided.

For example, U.S. Pat. No. 4,999,243, N. Maeda discloses a far infrared radiant composite fiber having a structure that includes a core surrounded by a sheath with a hollow space at the center. The core and the sheath are not mixed with one another.

These known underwear, socks and stockings that uses fiber having far infrared irradiating materials such as alumina, girconia, or magnesia, contained in polyethylene-based and polyamide-based fiber materials which show high permeability to far infrared radiation and the core fiber materials containing this far infrared irradiating materials is covered with a protective layer, as part of the component fiber, which is formed to provide a heat-retaining effect.

Problems to be Solved by this Invention

However, knitting and textile for underwear, socks and stockings mixed-spun with the wool manifest insufficient heat-retaining effect unless wool is mixed-spun at high ratio, but mixed-spinning wool at high ratio to increase the heat-retaining effect causes bulkiness of the underwear, the socks and the stockings, producing wearer discomfort; this not only reduces wearer comfort but also restricts movement of the wearer.

On the other hand, knitting and textile for underwear, socks and stockings mixed with far infrared irradiating ceramics can eliminate the bulkiness as compared with said underwear, said socks and said stockings mixed-spun with wool but the intended warming effect is difficult to achieve unless a large area is covered with the fiber material containing far infrared irradiating substance.

Moreover, since in these knitting and textile for underwear, socks and stockings, a covered layer is provided to protect the far infrared irradiating layer but the covered layer absorbs far infrared radiation, the far infrared radiation emitted by the ceramics is not effectively used.

Consequently, these knitting and textile for underwear, socks and stockings have limited effectiveness because the effect of the far infrared radiation is unable to work most effectively on contact when they are put on, provides less sufficient thermal conductivity while they are worn, and fail to maintain skin temperature after they were worn, so that excellent heat-retaining effects cannot be attained.

The composite fiber of U.S. Pat. No. 999,243 also has the problem on its structure that the sheath reduces far infrared radiation emitted from the core. The fiber further has serious problems in manufacturing. It is difficult to shape ceramics in fiber because of the natural character of ceramics that ceramics have no flexibility. In addition, single fiber is too fine to form the complicated struction of U.S. Pat. No. 4,999,243, comprising 2 portions, sheath portion and core portion. As a result, it is impossible in practice to produce the fiber on a commercial basis.

Therefore, the industry has long required knitting and textile for underwear, socks and stockings which provide superb wear comfort, which feels good when they are put on, which provide good thermal conductivity, and which exhibit excellent heat-retaining properties.

Means to Solve the Problems

All of the above-mentioned prior problems are solved by providing knitting and textile for underwear, socks and stockings comprising fiber containing metal which is characterized in comprising fiber materials mixed-spun with polyurethane elastic fiber in the range of 2–50%, to which platinum and at least one metal oxide selected from the group consisting of alumina, silica, and titania are mixed as essential components.

DETAILED DESCRIPTION OF THE INVENTION

Figure 1:
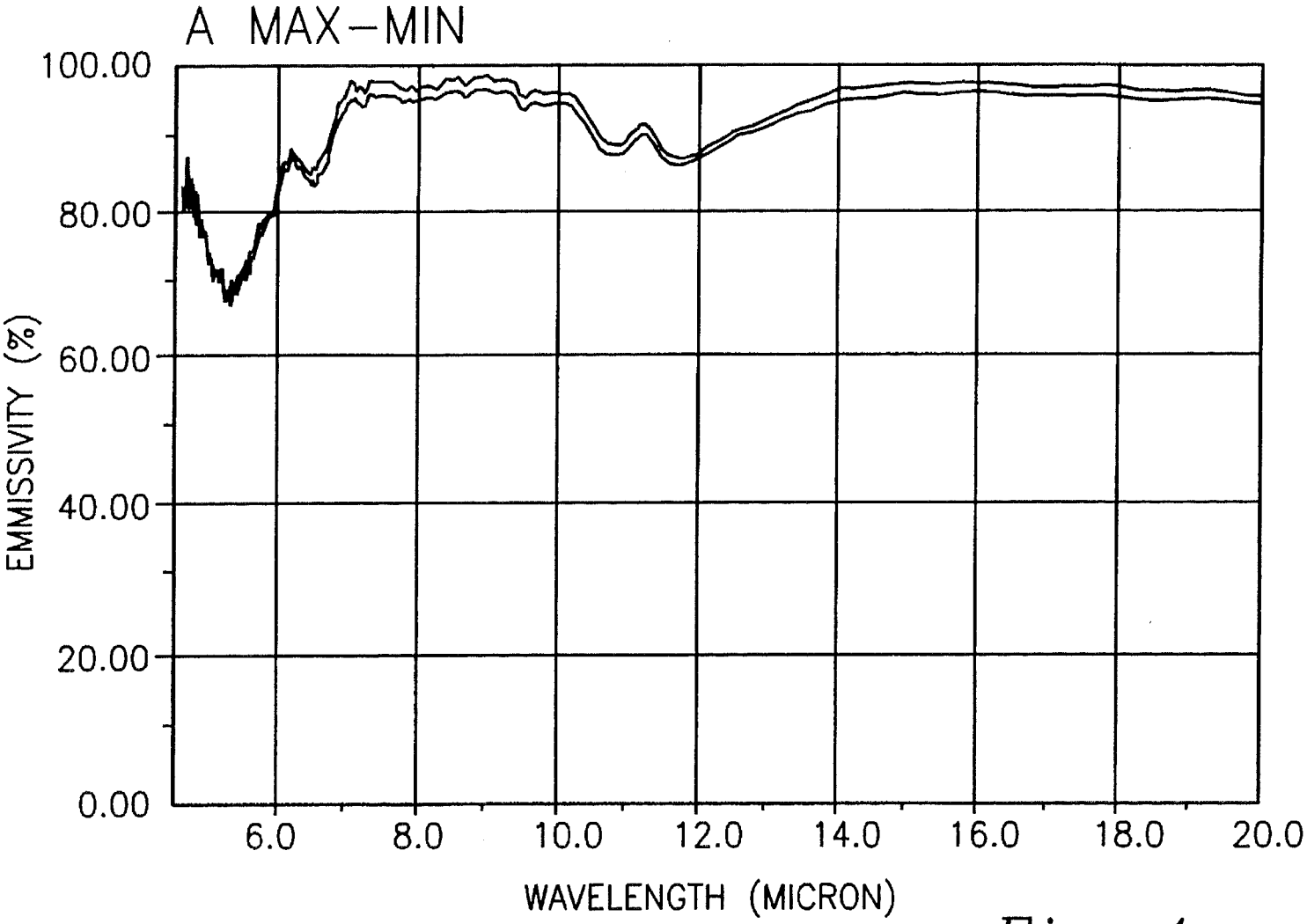
FIG. 1 is a spectral emissivity chart for the fiber obtained in Example 3.

The construction of knitting and textile for underwear, socks and stockings comprising fiber containing metal relating to the present invention will be described in detail hereinafter. The textile is used for underwear and the knitting is used for socks and stockings. All percentages are by weight.

In this invention, the fiber material mixed-spun with 2–50% polyurethane elastic fiber is mixed with platinum and at least one metal oxide selected from the group consisting of alumina ($Al_2O_3$), silica ($SiO_2$), and titania ($TiO_2$) as essential components and is referred to hereinafter as the component fiber.

Alumina ($Al_2O_3$), silica ($SiO_2$), and titania ($TiO_2$) in powder form with grain size of 1 μ or smaller are preferred, but there is no restriction.

Platinum (Pt) having a grain size as fine as 7–20 Å and in a colloidal form is preferably used.

This is based on the experimental knowledge of the inventor that the use of colloidal-form platinum can yield a satisfactory heat-retaining property.

The mix ratio of these metal oxides and platinum is about 9–5% alumina ($Al_2O_3$), 50–80% silica ($SiO_2$), 8–15% each titania ($TiO_2$) and/or platinum (Pt), but there is no restriction.

To these metal oxides, oxides of calcium, zinc, and copper may be mixed by about 2–10%.

From the metal oxides comprised as above, electromagnetic radiation (far infrared radiation) with a 5–12 micron wavelength range to be effective for human bodies is stably and sufficiently emitted even at the temperature range of around 30° C., as is clear from the following tests.

Polyurethane elastic fiber to which metal oxides and platinum are mixed is not particularly specified but SPANDEX which comprises noncrystalline segments including either polyester or polyether portions and crystalline segments with urethane bonds as is popularly used in regular textile products is favorably used.

A method for mixing metal oxides and platinum with said polyurethane elastic fiber is not particularly specified but any of the known optional methods can be adopted as required, such as the method for mixing the polymerized fiber material solution dispersedly in the solution before dry spinning or mixing into dry-spun yarns.

The blending ratio of metal oxides mixed in polyurethane elastic fiber is not particularly specified but any blending ratio can be favorably adopted if it is a blending ratio which emits electromagnetic radiation (far infrared radiation) with a wavelength range of about 5–12 microns to be effective for human bodies at the temperature around 30° C., and which provides thermal conductivity during wearing and which manifests a satisfactory heat-retaining effect and which is within the range that enables mixing or spinning and that does not impair wear comfort.

Furthermore, in the present invention, polyurethane elastic fiber is particularly used because that mixed-spinning polyurethane elastic fiber with generous expandability results in improved wear comfort of underwear, socks and stockings, and at the same time mixing the above-mentioned metal oxides and platinum to this polyurethane elastic fiber enables emission of electromagnetic radiation (far infrared radiation) from the metal oxides into the body with the underwear, the socks and the stockings closely in contact with the body of the wearer, makes the best use of the effect of emitted electromagnetic radiation (far infrared radiation), and allows the electromagnetic radiation (far infrared radiation) to work effectively on contact when they are put on and to provide good thermal conductivity, so that temperature variation in the body increases after they are worn, and the blood flow rate increases where they contact the wearer. As a result, a superior heat-retaining effect can be manifested.

The polyurethane elastic fiber mixed with at least platinum and at least one metal oxides selected from the above-mentioned group consisting of alumina ($Al_2O_3$), silica ($SiO_2$), and titania ($TiO_2$) as essential components is mixed-spun with other regular fiber materials into knitting and textile for underwear, socks and stockings by a regular method. In this embodiment, polyurethane elastic fiber including said metal oxides and platinum must be mixed-spun in the range of 2–50%.

This is because where the mixed-spinning ratio of polyurethane elastic fiber containing metal oxides is less than 2%, emission of electromagnetic radiation from metal oxides using the expandability of the above-mentioned polyurethane elastic fiber does not take place effectively and the superior heat-retaining property is not manifested, while where it is mixed-spun in amounts exceeding 50%, disagreeable touch is provided for the wearer and certain people may develop allergic symptoms, indicating that either of the alternatives is not desirable.

As other fiber materials to be mixed-spun with polyurethane elastic fiber, ordinary natural and artificial fiber materials such as cotton, hemp, wool, acrylic, polyester, and nylon are favorably used and these fiber materials may be optimally mixed-spun to make knitting and textile for underwear, socks and stockings at an optional ratio, and are not particularly specified.

In particular, underwear made by mixed-spinning cotton fiber in such a manner that the cotton fiber is located on the side in contact with the human body is favorably worn in the wintertime due to the heat-retaining property of the cotton fiber.

Or, underwear made by mixed-spinning the cotton fiber in such a manner that this cotton fiber is located opposite the side in contact with the human body is favorably worn in the summertime due to the heat dissipation property of the cotton fiber.

Regular men's underwear such as undershirts, athletic shirts, briefs, shorts, and drawers and regular ladies' underwear such as panties, tanks, panty hoses, semi-long sleeved shirts and tee shirts are given as examples of underwear included in the present invention, but the invention is not limited to these examples. The invention includes use of the novel material in all wearing apparel.

EXAMPLES

The effects of knitting and textile for underwear, socks and stockings comprising fiber containing metal relating to the present invention will become more apparent from the following examples.

Example 1

The 15% polyurethane elastic fiber mixed with metal oxides comprising alumina ($Al_2O_3$), silica ($SiO_2$), titania ($TiO_2$), and platinum (Pt) in the ratio 10:82:3:5 was mixed-spun with 85% cotton and made into ladies' tee shirts by an ordinary method.

Comparison 1

Ladies' tee shirts were made in the same manner of Example 1 except using polyurethane elastic fiber not mixed with metal oxides.

Comparison 2

The 1.7% polyurethane elastic fiber mixed with metal oxides comprising alumina ($Al_2O_3$), silica ($SiO_2$), titania ($TiO_2$), and platinum (Pt) in the ratio 10:82:3:5 was mixed-spun with 98.3% cotton and made into ladies' tee shirts by an ordinary method.

Comparison 3

Ladies' tee shirts were made in the same manner of Comparison 2 except using polyurethane elastic fiber not mixed with metal oxides.

Test 1

The ladies' underwear obtained in said Example 1 and Comparisons 1 through 3 were measured for various properties including density ($g/m^2$), thickness (cm), contact feeling (Q max), steady thermal conductivity (W/cm ° C.×$10^{-4}$), and heat-retaining ratio (%) with THERMO-LABO 2-KES7 (KATOHTEC: heat property measuring equipment).

Table 1 shows the results.

TABLE 1

| | [A] | [B] | [C] | [D] | [E] |
|---|---|---|---|---|---|
| EXAMPLE 1 | 154 | 0.065 | 0.091 | 4.906 | 28.6 |
| COMPARISON 1 | 149 | 0.068 | 0.102 | 3.855 | 25.3 |
| COMPARISON 2 | 235 | 0.137 | 0.073 | 8.913 | 26.3 |
| COMPARISON 3 | 233 | 0.140 | 0.078 | 9.020 | 26.9 |

[A] • • • DENSITY ($g/m^2$)
[B] • • • THICKNESS (cm)
[C] • • • CONTACT FEELING (Q max) ※1
[D] • • • STEADY THERMAL CONDUCTIVETY (W/cm °C. × $10^{-4}$) ※2
[E] • • • HEAT-RETAINING RATIO (%) ※3

※1: The coldness felt by wearer in putting on;
The bigger value indicates increased coldness.
※2: The facility of thermal conduction of cloth;
The bigger value indicates the increased thermal conduction.
※3: The ability of heat-retaining of cloth;
The bigger value indicates the better ability.

Test 2

Using the ladies' underwear obtained in said Example 1 and Comparisons 1 through 3, tests were carried out on the living body.

First of all, for ladies' underwear of Example 1 and Comparison 1, skin temperature (minimum, average, maximum) of the back of the same paneler before and after putting on the underwear was measured.

The measurement was carried out on temperature retained by the underwear about 1200 seconds after it was put on and skin temperature of the back right after and about 66 seconds after the underwear was taken off.

The overall temperature variation in skin temperature at the back was calculated.

Next, using the same paneler, the measurement was carried out on the ladies' underwear of Comparisons 2 and 3 in the same manner.

The measured skin temperatures in this test were calculated from minimum, average, and maximum values of the picture analysis temperature distribution of a specific region of the thermogram obtained from thermo analysis by thermograph (NEC San-Ei 6T/62 type (HgCdTe sensor, 8–13 μm): infrared radiation thermometer −50°–2000° C.).

Table 2 shows the results.

TABLE 2

| | [A] | [B] | [C] | [D] |
|---|---|---|---|---|
| EXAMPLE 1 | AVE. 34.25 | 34.63 (0.38) | 34.38 | 0.13↑ |
| | MIN. 33.00 | 33.50 (0.50) | 33.25 | 0.25↑ |
| | MAX. 35.13 | 35.63 (0.47) | 35.38 | 0.25↑ |
| COM-PARISON 1 | AVE. 34.13 | 33.88 (−0.25) | 33.63 | −0.50↓ |
| | MIN. 32.88 | 32.50 (0.38) | 32.25 | −0.63↓ |
| | MAX. 35.13 | 35.00 (−0.13) | 34.75 | −0.38↓ |
| COM-PARISON 2 | AVE. 34.01 | 34.11 (0.10) | 33.94 | −0.07↓ |
| | MIN. 32.88 | 32.22 (0.01) | 32.10 | −0.11↓ |
| | MAX. 35.01 | 35.23 (0.22) | 35.10 | 0.09↑ |
| COM-PARISON 3 | AVE. 34.52 | 34.70 (0.18) | 34.55 | 0.03↑ |
| | MIN. 32.91 | 32.85 (−0.06) | 32.84 | −0.07↓ |
| | MAX. 35.21 | 35.51 (0.30) | 35.30 | 0.09↑ |

[A] • • • BEFORE PUTTING ON/HEAT-RETAINING FOR 1,200 SEC.
[B] • • • RIGHT AFTER TAKING OFF
[C] • • • RADIATION OF HEAT/RADIATION FOR 66 SEC.
[D] • • • OVERALL TEMPERATURE VARIATION
THE UPPER ROW: AVERAGE TEMPERATURE (°C.)
THE MIDDLE ROW: MINIMUM TEMPERATURE (°C.)
THE LOWER ROW: MAXIMUM TEMPERATURE (°C.)
( ) indicates temperature of heat-retaining effect.

Test 3

The ladies' underwear of said Example 1 and comparison 1 were respectively worn by two panelers, and the blood flow rate (ml/min/100 g) was measured by the laser Doppler method (Journal of the Laser Medical Society of Japan Vol. 12, No. 1, 7. 1988) using the laser Doppler rheometer (ADVANST: ALF-21) where the underwear was worn for a specified period. Table 3 shows the results.

TABLE 3

| | BLOOD FLOW OF FINGER (ml/min/100 g) | |
|---|---|---|
| | PANELER A | PANELER B |
| EXAMPLE 1 | 30<br>11:40–11:50 | 31<br>11:00–11:06 |
| COMPARISON 1 | 22<br>10:40–10:50 | 14<br>11:50–12:00 |

THE LOWER ROW• • • TIME OF MEASUREMENT

As clear from TABLE 1, , where the mixed-spinning ratio of polyurethane elastic fiber is 15%, comparing ladies' underwear mixed with metal oxide (Example 1) with that not mixed with metal oxide (Comparison 1) shows that small contact feeling results in small coldness when it is put on and small steady thermal conductivity results in small temperature variation due to the coldness of open-air, proving a high heat-retaining ratio.

Where polyurethane elastic fiber is mixed-spun as low as 1.7% (Comparison 2), the effect is similar to that of using polyurethane elastic fiber not containing metal oxides (Comparison 3), showing that the heat-retaining effect is not sufficiently manifested.

As clear from TABLE 2, where the mixed-spinning ratio of polyurethane elastic fiber is 15%, in the balance of heat-retaining and heat-radiation after putting on the underwear, the ladies' underwear containing metal oxides (Example 1) provides an overall temperature variation difference of 0.6° C. higher on average than that of ladies' underwear not containing metal oxides (Comparison 1), showing higher heat-retaining effect.

On the contrary, where the mixed-spinning ratio of polyurethane elastic fiber is low (Comparisons 2 and 3), the heat-retaining effect by wearing underwear is not manifested.

As clear from TABLE 3, the ladies' underwear of Example 1 tends to increase the blood flow rate by heat-retaining as compared with the ladies' underwear of Comparison 1.

Example 2

The 6.4% polyurethane elastic fiber mixed with metal oxides comprising alumina ($Al_2O_3$), silica ($SiO_2$), titania ($TiO_2$), and platinum (Pt) in the ratio 10:82:3:5 was mixed-spun with 56% cotton, 24.1% acrylic, and 13.5% nylon, and made into ladies' socks by an ordinary method.

Comparison 2

Ladies' socks were made in the same manner of Example 1 except using polyurethane elastic fiber not mixed with metal oxides.

Comparison 5

The 1.7% polyurethane elastic fiber mixed with metal oxides comprising alumina ($Al_2O_3$), silica ($SiO_2$), titania ($TiO_2$), and platinum (Pt) in the ratio 10:82:3:5 was mixed-spun with 62.7% cotton, 27.6% acrylic, and 5.2% nylon, and made into men's socks by an ordinary method.

Comparison 6

Men's socks were made in the same manner of Comparison 2 except using polyurethane elastic fiber not mixed with metal oxides.

Test 4

The ladies' and men's socks obtained in said Example 2 and Comparisons 4 through 6 were measured for various properties including density (g/m$^2$), thickness (cm), contact feeling (Q max), steady thermal conductivity (W/cm ° C.×10$^{-4}$), and heat-retaining ratio (%) with THERMO-LABO 2-KES7 (KATOHTEC: heat property measuring equipment).

Table 4 shows the results.

TABLE 4

| | [A] | [B] | [C] | [D] | [E] |
|---|---|---|---|---|---|
| EXAMPLE 2 | 286 | 0.102 | 0.083 | 3.525 | 42.3 |
| COMPARISON 4 | 287 | 0.111 | 0.089 | 4.719 | 35.2 |
| COMPARISON 5 | 438 | 0.221 | 0.064 | 8.495 | 39.7 |
| COMPARISON 6 | 438 | 0.236 | 0.068 | 8.873 | 45.4 |

[A] • • • DENSITY (g/m$^2$)
[B] • • • THICKNESS (cm)
[C] • • • CONTACT FEELING (Q max) ※1
[D] • • • STEADY THERMAL CONDUCTIVETY (W/cm °C. × 10$^{-4}$) ※2
[E] • • • HEAT-RETAINING RATIO (%) ※3
※1: The coldness felt by wearer in putting on; The bigger value indicates increased coldness.
※2: The facility of thermal conduction of cloth; The bigger value indicates increased thermal conductivity facility.
※3: The ability of heat-retaining of cloth;

TABLE 4-continued

| | [A] | [B] | [C] | [D] | [E] |
|---|---|---|---|---|---|

The bigger value indicates increased heat retention ability.

Test 5

Using the ladies' and men's socks obtained in said Example 2 and Comparisons 4 through 6, tests were carried out on the living body.

First of all, skin temperature of right and left soles of a paneler were measured as the skin temperature before putting on socks, after adjusting on the living body for a specified period to harmonize the skin temperature of the right and left soles.

After the measurement, the sock of Example 2 was put on the left foot, the sock of Comparison 4 was put on the right foot, and skin temperature (average, maximum) of the soles was measured after for 900 seconds.

Then, the right and left socks were taken off, skin temperature (average, maximum) of the right and left soles was measured immediately after and about 61 seconds thereafter.

The overall temperature variation in skin temperature at the right and left soles while wearing the socks was calculated.

Next, using the same paneler, skin temperature of right and left soles was adjusted on the living body for a specified period in the same manner, the sock of Comparison 5 was put on the left foot, the sock of Comparison 6 was put on the right foot, and skin temperature (average, maximum) of the soles and the overall temperature variation in skin temperature were measured in the same manner.

The measured skin temperatures in this test were calculated from average and maximum values of the picture analysis temperature distribution of a specific region of the thermogram obtained from thermo analysis by thermograph (NEC San-Ei 6T/62 type (HgCdTe sensor, 8–13 μm): infrared radiation thermometer −50°–2000° C.).

Table 5 shows the results.

TABLE 5

| | [A] | [B] | [C] | [C] | [D] |
|---|---|---|---|---|---|
| EXAMPLE 2 | 29.3 | 29.1 | 31.1 (1.0) | 31.1 | 1.8 ↑ |
| | 31.5 | 31.5 | 33.8 (2.3) | 33.8 | 2.3 ↑ |
| COMPARISON 4 | 31.2 | 30.2 | 32.8 (0.5) | 32.8 | 1.6 ↑ |
| | 33.5 | 32.3 | 34.7 (1.2) | 34.7 | 1.2 ↑ |
| COMPARISON 5 | 32.6 | 32.1 | 33.1 (0.5) | 32.8 | 0.2 ↑ |
| | 34.3 | 34.0 | 35.2 (0.9) | 34.6 | 0.3 ↑ |
| COMPARISON 6 | 31.6 | 32.0 | 32.6 (1.0) | 32.6 | 1.0 ↑ |
| | 33.7 | 34.0 | 34.2 (0.5) | 34.2 | 0.5 ↑ |

[A] • • • BEFORE PUTTING ON
[B] • • • WEARING AND HEAT-RETAINING /HEAT-RETAINING FOR 900 SEC.
[C] • • • RIGHT AFTER TAKING OFF
[D] • • • RADIATION OF HEAT/RADIATION FOR 66 SEC.
[E] • • • OVERALL TEMPARATURE VARIATION
THE UPPER ROW: AVERAGE TEMPARATURE (°C.)
THE LOWER ROW: MAXIMUM TEMPARATURE (°C.)
( ) indicates temperature of heat-retaining effect.

Test 6

The ladies' socks of said Example 2 and Comparison 4 were respectively worn by the same paneler on the hand, and the blood flow rate (ml/min/100 g) was measured by the laser Doppler method (Journal of the Laser Medical Society of Japan Vol. 12, No. 1 , 7. 1988) using the laser Doppler rheometer (ADVANST: ALF-21) in both of retaining heat and heating by irradiation from a lamp.

Table 6 shows the results.

TABLE 6

| | BLOOD FLOW OF FINGER (ml/min/100 g) |
|---|---|
| EXAMPLE 1 | 23.5 |
| | 24.0 ※ |
| COMPARISON 1 | 22.0 |
| | 24.0 ※ |

※ THE LOWER ROW• • • HEATING BY IRRADIATION FROM LAMP

AS clear from TABLE 4, in case that mixed-spinning ratio of polyurethane elastic fiber is 6.2%, comparing ladies' socks mixed with metal oxide (Example 2) with that not mixed with metal oxide (Comparison 4) shows that the density and thickness are small, however small contact feeling results in small coldness when they are put on and small steady thermal conductivity results in small temperature variation due to the coldness of open-air, proving a high heat-retaining ratio.

Where polyurethane elastic fiber is mixed-spun as low as 1.7% (Comparison 5), the effect is similar to that using polyurethane elastic fiber not containing metal oxides (Comparison 6), thereby showing that heat-retaining effect is not sufficiently manifested.

As clear from TABLE 5, where the mixed-spinning ratio of polyurethane elastic fiber is 6.4%, in the balance of heat-retaining and heat-radiation after putting on the socks, the socks containing metal oxides (Example 2) provide an overall temperature variation difference that is 0.2° C. higher on average and 1.1° C. higher on maximum than that of socks not containing metal oxides (Comparison 4), thereby showing higher heat-retaining effect.

On the contrary, where the mixed-spinning ratio of polyurethane elastic fiber is low (Comparisons 5 and 6), the heat-retaining effect by wearing socks is not manifested.

As clear from TABLE 6, the socks of Example 2 tend to increase the blood flow rate by heat-retaining as compared to the socks of Comparison 4.

Example 3

The 15% polyurethane elastic fiber containing metal oxides comprising alumina ($Al_2O_3$), silica ($SiO_2$), titania ($TiO_2$), and platinum (Pt) in the ratio 10:82:3:5 is mixed-spun with 85% cotton to make fiber.

Example 4

The 18% polyurethane elastic fiber same as said Example 3 are mixed-spun with 82% cotton to make fiber.

Example 5

The 28% polyurethane elastic fiber same as said Example 3 are mixed-spun with 72% cotton into fiber.

Example 6

The 50% polyurethane elastic fiber same as said Example 3 are mixed-spun with 50% staple fiber to make fiber.

Example 7

The 17% polyurethane elastic fiber same as said Example 3 are mixed-spun with 83% nylon to make fiber.

Test 7

For the fiber obtained by Examples 3 through 7, spectral emissivity was measured.

Measuring conditions are the wavelength range: 4.5–20.0 μm; resolution: 16 $cm^{-1}$; detector: wide-range MCT; measuring temperature: 33° C. for surface temperature of texture; measuring position and time: four times in total, each once at two different positions and twice at the same position.

Figure 2:
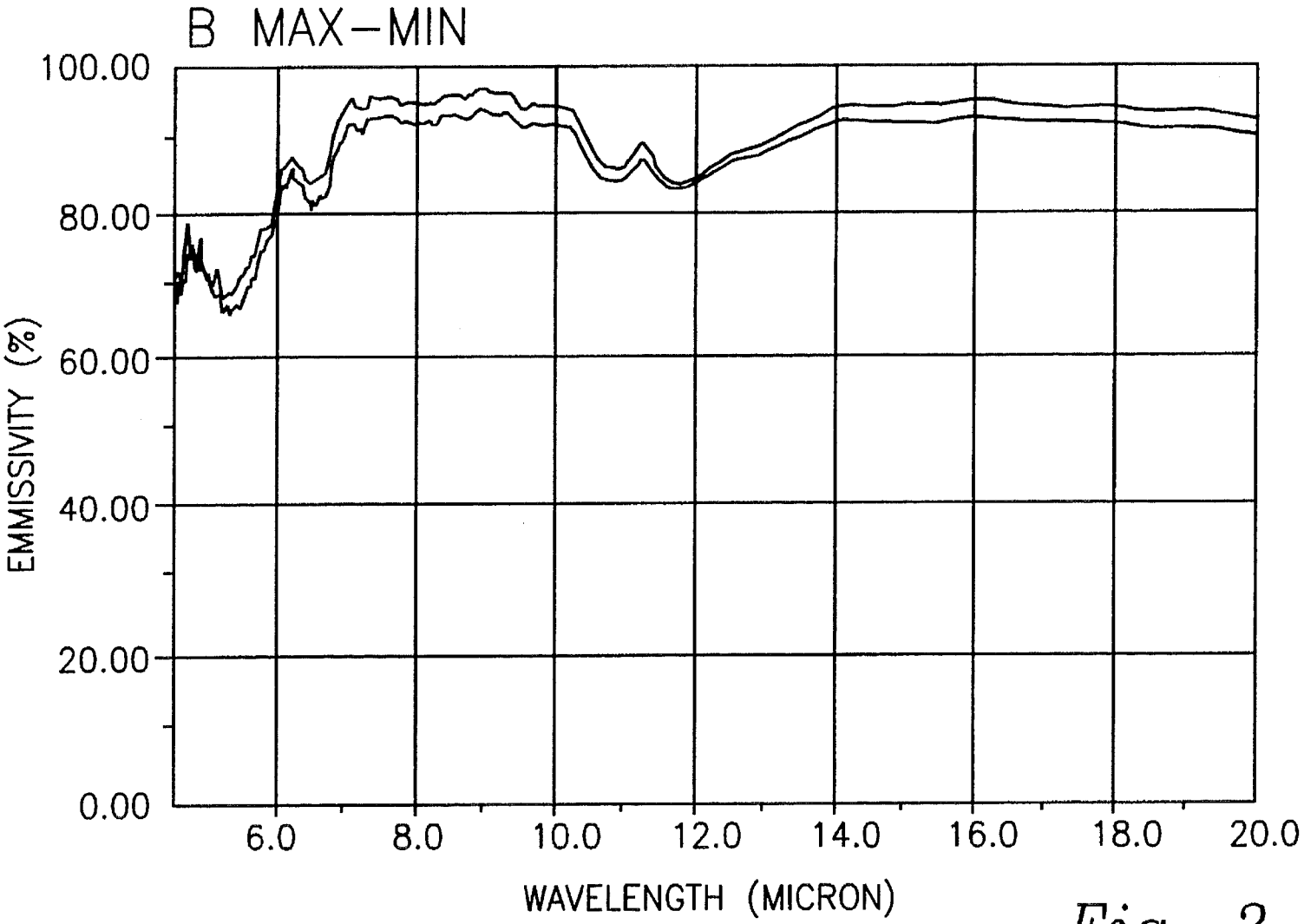
FIG. 2 is a spectral emissivity chart for the fiber obtained in Example 2.
Figure 3:
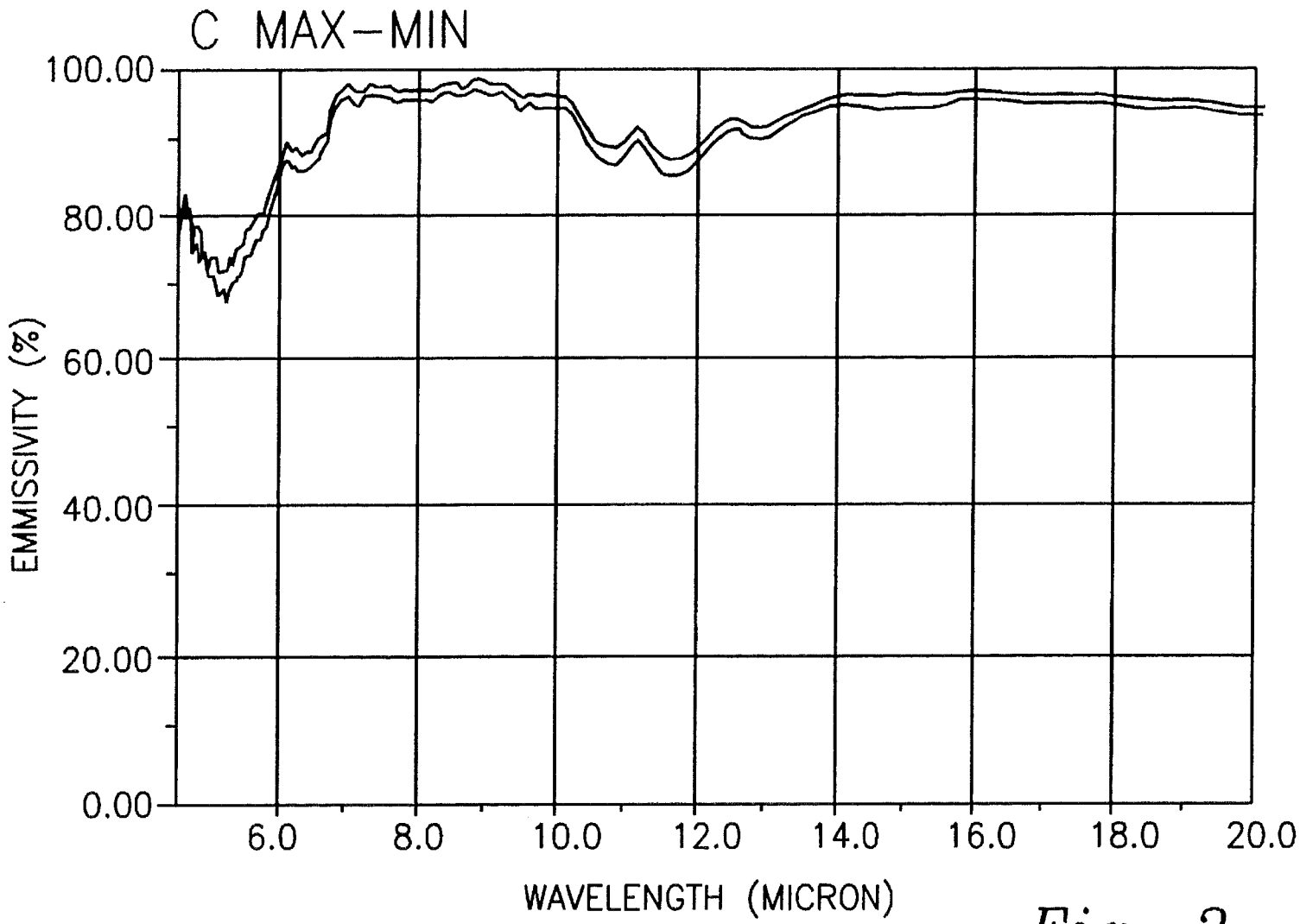
FIG. 3 is a spectral emissivity chart for the fiber obtained in Example 5.
Figure 4:
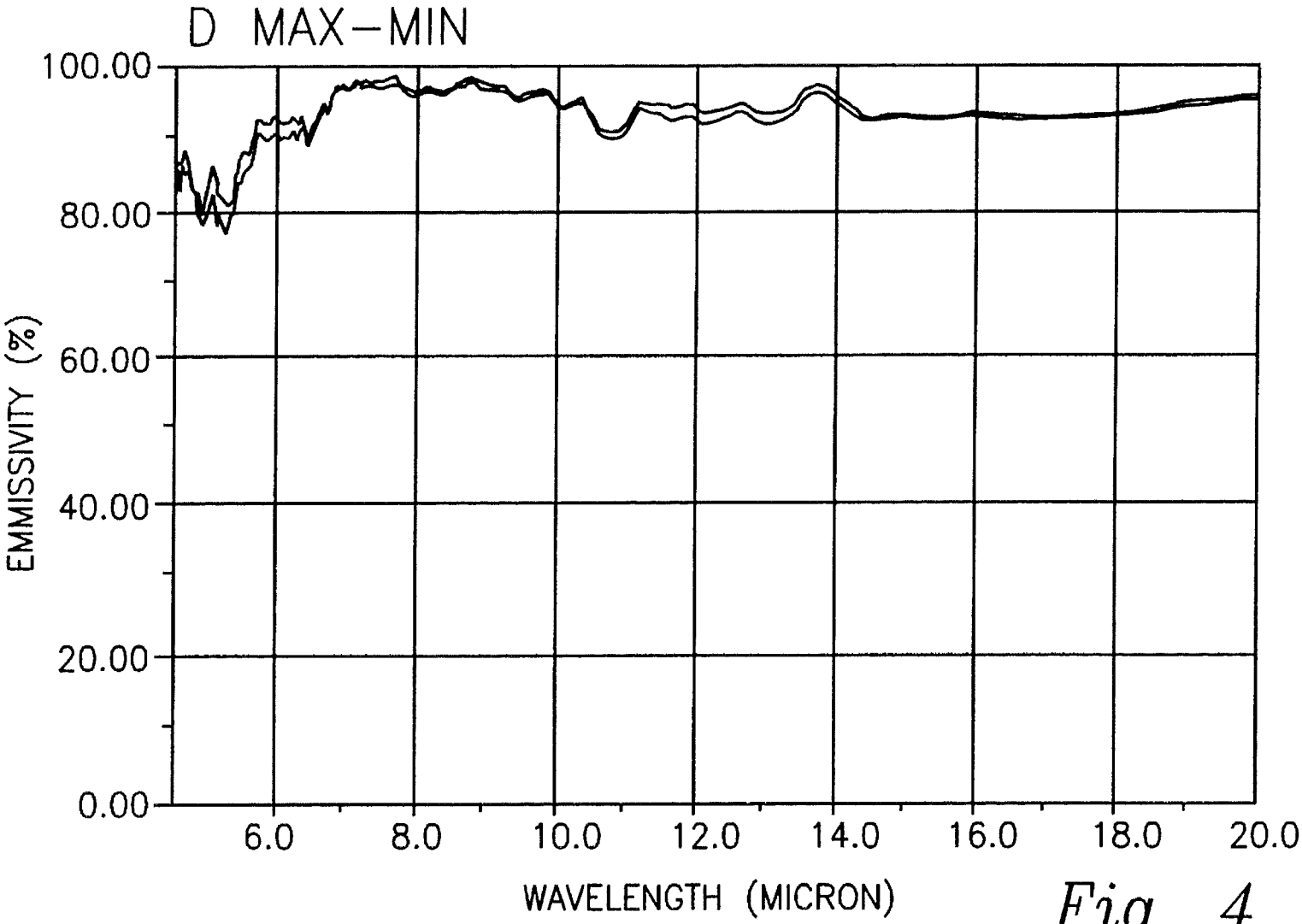
FIG. 4 is a spectral emissivity chart for the fiber obtained in Example 6.
Figure 5:
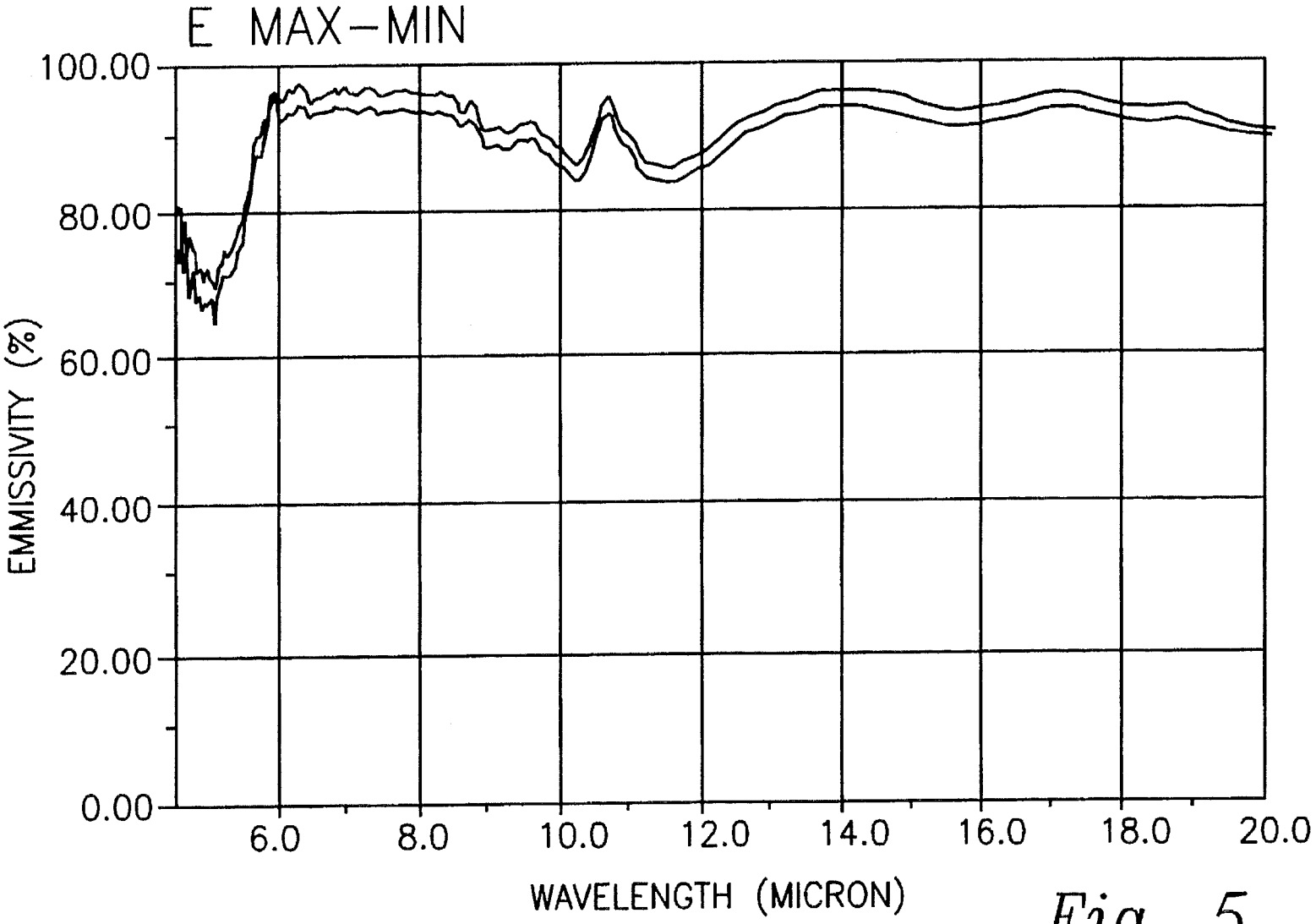
FIG. 5 is a spectral emissivity chart for the fiber obtained in Example 7.

FIGS. 1 through 5 show the obtained relevant spectral emissivity.

As clear from the obtained spectral emissivity, in the fiber obtained in Examples 3 through 7, electromagnetic radiation (far infrared radiation) with wavelengths about 5–12 microns to be effective for human bodies are emitted even at the comparatively low temperature range of 33° C.

Effects of the Invention

As described above in detail, because the present invention relates to knitting and textile for underwear, socks and stockings comprising fiber containing metal, which is characterized in comprising fiber material mixed-spun with 2–50% polyurethane elastic fiber, to which at least platinum and one metal oxides selected from the group consisting of alumina, silica, and titania are mixed as essential components, bulkiness of the underwear, the socks and the stockings is nominal and agreeable wear comfort such as flexibility and expandability is ensured when they are put on, and at the same time because electromagnetic radiation (far infrared radiation) by metal oxides is emitted in close contact with the wearer by making use of the expandability of polyurethane elastic fiber, as clear from the results of said tests, electromagnetic radiation (far infrared radiation) is permitted to work effectively on contact when they are put on and provides good thermal conductivity while it is worn, enabling manifestation of an extremely excellent heat-retaining effect.

I claim:

1. A far infrared radiant composite fiber comprising polyurethane elastic material:

said fiber including platinum and at least one metal oxide selected from the group comprising alumina, silica, and titania, the platinum and at least one metal oxide being distributed throughout said fiber;

said polyurethane elastic material facilitating the escape of heat from said composite fiber;

said composite fiber having a far infrared emissivity of at least 80% on average in the spectral range from 6.0 um to 20.0 um at 30 degrees C.

* * * * *